US007328871B2

(12) United States Patent
Mace et al.

(10) Patent No.: US 7,328,871 B2
(45) Date of Patent: Feb. 12, 2008

(54) RAILROAD CAR COUPLER GAP ANALYZER

(75) Inventors: Stephen E. Mace, Pueblo, CO (US); Robert W. Martin, Jr., Colorado City, CO (US); Stephen N. Handal, Colorado Springs, CO (US)

(73) Assignee: Progressive Rail Technologies, Inc., Pueblo West, CO (US)

( * ) Notice: Subject to any disclaimer, the term of this patent is extended or adjusted under 35 U.S.C. 154(b) by 357 days.

(21) Appl. No.: 11/105,751

(22) Filed: Apr. 14, 2005

(65) Prior Publication Data

US 2006/0231685 A1 Oct. 19, 2006

(51) Int. Cl.
*B61K 1/00* (2006.01)

(52) U.S. Cl. ..... 246/169 R

(58) Field of Classification Search ..... 246/167 R, 246/169 R, 169 D, 169 S; 73/865.9, 866.1
See application file for complete search history.

(56) References Cited

U.S. PATENT DOCUMENTS

| | | | | |
|---|---|---|---|---|
| 4,412,212 | A | 10/1983 | Kolegraff et al. | |
| 5,198,800 | A | 3/1993 | Tozawa et al. | |
| 5,331,311 | A * | 7/1994 | Doctor | 340/463 |
| 5,660,470 | A | 8/1997 | Mench | |
| 6,313,753 | B1 | 11/2001 | Butler | |
| 6,411,215 | B1 * | 6/2002 | Shnier | 340/686.1 |
| 6,717,514 | B1 | 4/2004 | Stein et al. | |
| 6,778,092 | B2 | 8/2004 | Braune | |
| 6,812,850 | B2 | 11/2004 | Matsumiya et al. | |
| 2002/0196155 | A1 | 12/2002 | McNulty, Jr. | |
| 2003/0160701 | A1 | 8/2003 | Nakamura et al. | |

* cited by examiner

*Primary Examiner*—S. Joseph Morano
*Assistant Examiner*—Robert J. McCarry, Jr.
(74) *Attorney, Agent, or Firm*—Rick Martin; Patent Law Offices of Rick Martin, P.C.

(57) ABSTRACT

In trains a dragging air hose can snag an object on the tracks and break. A broken air hose can lead to an emergency stop or an accident caused by faulty brakes. The present invention mounts a video camera opposite a lit screen, thereby contrasting the air hose profile against a white screen in all weather and lighting conditions. Machine vision algorithms locate the air hose in a captured image from a moving train, and compute its lowest point. An alarm condition is sent to a remote location. An optional car gap detector is laser based. It helps align the car gap with the data capture for the camera. Another subsystem can include a car coupler height detection algorithm.

22 Claims, 13 Drawing Sheets

| AIR HOSE INDEX | TIME | AIR HOSE HEIGHT | LEAD COUPLER HEIGHT | TRAIL COUPLER HEIGHT | LEAD CAR NUMBER | TRAIL CAR NUMBER |
|---|---|---|---|---|---|---|
| 1 | 5815.895 | 11.111 | 40.222 | 39.556 | RCAR 1000 | RCAR 1001 |
| 2 | 6849.089 | 9.333 | 39.778 | 39.778 | RCAR 1002 | RCAR 1003 |
| 3 | 7884.713 | 9.889 | 40 | 39.889 | RCAR 1004 | RCAR 1005 |
| 4 | 8920.445 | 10.444 | 39.667 | 39.889 | RCAR 1006 | RCAR 1007 |
| 5 | 9957.198 | 10.111 | 39.667 | 39.778 | RCAR 1008 | RCAR 1009 |
| 6 | 12042.447 | 9.889 | 39.889 | 40.111 | RCAR 1010 | RCAR 1011 |
| 7 | 13087.887 | 10.778 | 39.667 | 39.556 | RCAR 1012 | RCAR 1013 |
| 8 | 15187.308 | 9.444 | 39.444 | 39.222 | RCAR 1014 | RCAR 1015 |
| 9 | 16239.815 | 9 | 39.556 | 39.222 | RCAR 1016 | RCAR 1017 |

EXAMPLE AIR HOSE/COUPLER HEIGHT OUTPUT FILE

FIG.14

PRT INSTANT WARNING
LOW AIR HOSE DETECTOR #10
TRAIN DIRECTION EAST BOUND
DATE 2/23/05
TIME 14:57:45 PACIFIC
FILE 02230534

LOW AIRHOSE WARNING:
02230534 TTGX 971668 TTGX 973367 26 27 AIR HOSE HEIGHT: 3.8"

1ST DETECTED CAR: BSNF 4091

EXAMPLE LOW AIR HOSE WARNING FILE FOR NETWORK TRANSMISSION

FIG.15

RAILROAD CAR COUPLER GAP ANALYZER

FIELD OF INVENTION

The present invention relates to using a machine vision system to scan passing railroad cars in a train in order to detect a low hanging air hose and/or coupler, thereby avoiding a broken air hose and/or uncoupling which can cause emergency braking or accidents

BACKGROUND OF THE INVENTION

It is common practice by railroad industries worldwide to utilize an air braking system on both passenger and freight trains. The air brake system is typically composed of a compressed air source and control valves that are normally located on the locomotives and connected through a series of pipes and hoses to the brake valves and brake actuators on each railroad car. The air supply is carried across the span between coupled railroad cars, referred to herein as the "coupler gap", through a flexible hose/coupler arrangement 26 and 27 in FIG. 8. The air hose coupler, commonly referred to as the "glad hand", is susceptible to unintended uncoupling if the air hose assembly hangs down sufficiently such that it strikes objects in the track as the train is in motion. By design, any loss of pressure in the air brake system causes the entire train to automatically go into an emergency brake mode and come to a stop, disrupting normal train operations.

The invention described herein is designed to measure the height of the air hose assembly in the coupler gap area between each pair of coupled railroad cars and to automatically send a warning if the minimum air hose height is found to be below a certain limit above the top of rail, typically 4-5 inches. The invention relies on a "machine vision" system that utilizes a camera and computer interface to acquire images of the coupler gap area continuously through the train. These coupler gap images are analyzed in real time with a computer program that seeks to identify the air hose in each image and measure the minimum height of the air hose relative to the top edge of the rail in the image. The invention functions automatically and unattended by virtue of a computerized control system.

An additional function of the invention is to measure the height of each railroad car coupler above the top edge of the rail (FIG. 3). Freight and passenger railroads enforce limits as to the height variation of the coupler above the top of rail to avoid significant mismatches between mating coupler heights. Significant mismatches between mating coupler heights have been shown to create vertical force moments that can unload a railcar's wheels and cause derailments.

The coupler height measurement functions in tandem with the air hose height measurement system requiring no additional equipment. However, the image analysis software program is modified by the addition of an image analysis module that seeks to find the mating couplers in the coupler gap image and measure the height of each coupler shank mid-point above the top of rail. The coupler height value is then compared to the limits imposed by the railroad and a warning issued if coupler height falls outside of this range.

Historically, manual inspection of parked railroad cars has been used to detect a low hanging air hose. If a low hanging air hose catches debris on the ground and brakes, then an emergency braking sequence is initiated. These emergency braking scenarios cost railroads millions of dollars of lost revenue through down time. Also, if the emergency braking mechanisms were to fail, then a lack of braking pressure in a train causes a dangerous situation.

A brief summary of methods/apparatus for remotely detecting whether a specific object is in a safe position follows below.

Prior art consists of devices designed to detect low hanging air hose assemblies by detecting when such assemblies break one or more laser beams aimed across the railroad track to a receiver on the other side of the track. A monitoring system detects the change in the laser receiver output signal when the low hanging air hose blocks the beam and prevents it from impinging on the receiver. These devices are typically installed at a fixed height(s) above the top of the rails and may have single or multiple laser transmitter/receiver pairs. The devices typically include a railroad car wheel detector and railroad car radio identification tag reader such that the interrupting air hose assemblies can be associated with the appropriate pair of coupled railroad cars. The railroad car wheel detector data is also used to locate the coupler gaps where low-hanging air hose assemblies are located as other components in the train, such as wheels and truck frames, also interrupt the laser beams.

U.S. Pat. No. 6,411,215 (2002) to Shnier discloses placing a retro-reflective surface on a target such as a door's locking handle. Then a narrow light beam is focused on the desired position of the retro-reflective surface. If a monitoring device does not sense the reflected light, then an alarm is activated. Unfortunately, the dirt and grime associated with railroad coupling and braking devices would defeat this approach for detecting a low air hose.

U.S. Pat. No. 6,717,514 (2004) to Stein et al. discloses a radio transmitter mounted to a target. A trio of spatially positioned receivers detect an alarm condition when the transmitter is located outside of a safe perimeter. Unfortunately, the installation and maintenance of countless radio transmitters on air hose elements would be costly and prone to failures of the radio transmitters.

U.S. Pat. No. 6,778,092 (2004) to Braune discloses a camera, laser or two cameras connected to an evaluating unit which determines (using software) location and time variables in a safety zone of a robotic machine installed in a factory. The machine can be shut down when predetermined danger conditions exist. This technique is somewhat similar to the present invention, except the logic needed to analyze a passing train is not suggested, nor are solutions to variable outside weather and light conditions suggested.

U.S. Pat. No. 6,812,850 (2004) to Matsuuiya et al. discloses a CCD camera moving in X, Y, Z axes to track a work piece. A protector on the camera includes an antenna and a strain detector, used to prevent a collision of the camera and the work piece.

Pub. No. US2002/0196155 to McNulty, Jr. discloses a fixed laser beam hitting a mirror on a target. A door opening moves the mirror, interrupting the reflected beam, and signaling an alarm.

Pub. No. US2003/0160701 to Nakamura et al. discloses a container contents proximity sensor with a wireless transmitter to detect a terrorist entry into a container.

Salient Systems, Inc. discloses a low hose detector using an optical sensor, a light curtain sensor, to examine the area between railroad cars. Car tag readers also log offending cars. A plurality of lasers are beamed across the track and sensed by receivers. By measuring the height of the lowest beam interrupted by the air hose, a low air hose is detected, as well as all heights of all passing air hoses to within an inch.

GE Transportation Rail® produces a dragging equipment detector that consists of a bar mounted across the tracks. The bar is height adjustable to detect a low air hose by sensing the impact with the bar.

Lynxrail™, www.lynxrail.com, produces a video imaging system for passing railroad cars. It monitors via machine vision algorithms wheel profiles, brake shoe wear, springs, car identification, hand brake and draft gear. No backlit screen or equivalent is known to be used to compensate for daytime, nighttime and ambient weather conditions.

The prior art has the following problems:

1. Proper alignment of the laser transmitter and receiver must be maintained at all times.

2. The laser beam devices must be mounted across and in close proximity to the track and are subjected to severe vibrations that can cause the laser beam to deflect from the receiver, especially when railroad car wheels with flat spots pound the rails.

3. The housings for the laser and receiver interfere with normal track maintenance activities and may pose a trip hazard to railroad workers.

4. The simple beam-break approach is very poor at discriminating shapes and sizes. Broken straps, cables, debris precipitation and other objects can block the laser beam and cause a signal change at the receiver, referred to as a "false positive."

5. The prior art only detects low hanging air hose assemblies and cannot be used for other detection tasks.

The present invention compensates for all lighting conditions by providing a lit screen or other light uniform background, such as a building or wall, to backlight the space between passing railroad cars. A camera is used to detect a low air hose via machine vision algorithms. A car gap detector can be used to utilize a laser beam to sense when the gap between the cars is properly lined up with the video camera. A wheel counter can identify the car with a defectively low air hose. An image acquisition control computer can send an alarm to a remote location via the internet.

The invention described herein offers significant improvements over the prior art:

1. The imaging camera is located well off the track (27' from track centerline) in a protective enclosure and is not subjected to vibrations.

2. Being located well off the track, the imaging camera does not interfere with normal track maintenance activities in any way or create a trip hazard to railroad workers.

3. The image analysis software contains sophisticated algorithms to discriminate against any object in the image that does not have the precise characteristic size and shape of an air hose. The analytical technique executed in the software is very proficient at avoiding false positive indications from broken straps, cables, debris, precipitation or other objects that may enter the field of view of the imaging camera.

4. The invention is also useful for measuring the railroad car coupler heights which are also located in the same "coupler gap" areas as the air hose assemblies.

BRIEF SUMMARY OF THE INVENTION

An aspect of the present invention is to provide an air hose height detection system using a camera and a back lit screen, building, or wall to highlight the air hose video profile in all weather and light conditions.

Another aspect of the present invention is to provide a weather resistant enclosure for the camera.

Another aspect of the present invention is to provide three methods of detecting the "coupler gap" between adjacent railroad cars where the air hose assemblies reside.

Another aspect of the present invention is to provide a reliable machine vision algorithm to detect a low air hose.

Another aspect of the present invention is to provide a remote alarm communication sub-system connected to the low air hose detector.

Another aspect of the present invention is to provide a car coupler height detector within the same system as the low-air hose detector.

Other aspects of this invention will appear from the following description and appended claims, reference being made to the accompanying drawings forming a part of this specification wherein like reference characters designate corresponding parts in the several views.

An enclosed camera is mounted to aim perpendicular to a train track at a screen installed on the opposite side of the track. The screen has a light source. The source could be a searchlight aimed at it, or internal bulbs or a searchlight aimed from the back and through the screen. The screen could be replaced with a lightly colored uniform background, such as the side of a building or wall, with illumination for uniform image background at night or in low light conditions.

As a train passes by at perhaps forty miles per hour, the air hose is contrasted against the screen to create a video image captured by a control computer. Custom algorithms reliably define the outline of each air hose and determine a low air hose condition. Optional car coupler finder algorithms also operate.

A camera resides at the side of the track and images the specific coupler gap area of a passing train. An illuminated back light panel or wall provides for consistent contrast and nighttime operation. A sophisticated camera exposure adjustment algorithm compensates for variable ambient lighting conditions. A method of signaling the camera imaging system that a coupler gap is present in the camera field of view and to acquire the current image frame is provided. A "hose finder" algorithm detects hoses in images and finds their lowest point above the top of rail. The "hose finder" algorithm discriminates against cables, straps, and other objects in coupler gap. The top of rail is automatically detected by a machine vision algorithm for hose height measurement.

BRIEF DESCRIPTION OF THE DRAWINGS

FIG. 14 is an example chart of an air hose/coupler height output file.

FIG. 15 is an example file for a low air hose warning ready for network transmission.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
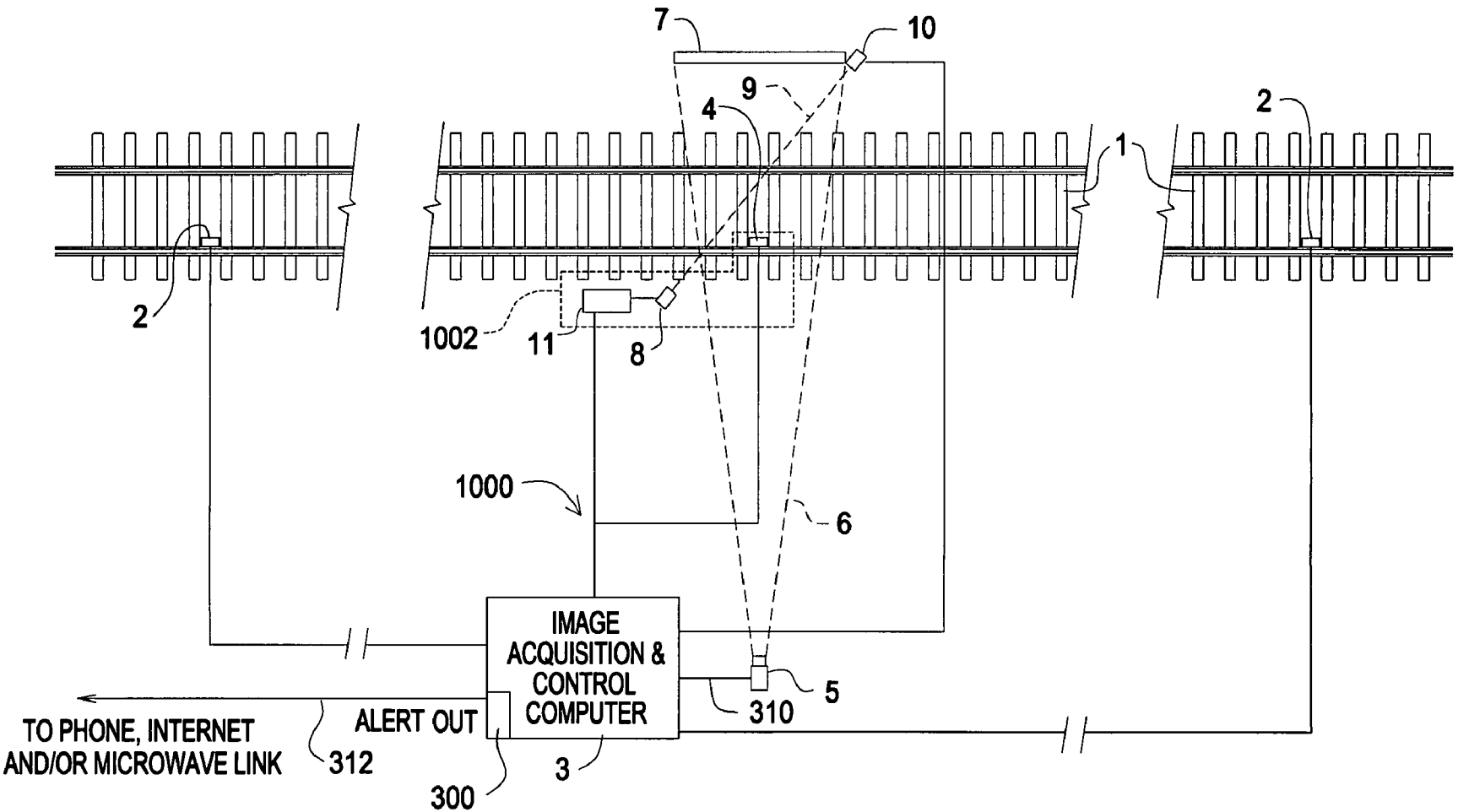
FIG. 1 is a schematic view of the air hose height detection system.

Referring first to FIG. 1 an air hose height detector system 1000 consists of a train presence wheel sensor 2 at either end mounted on the tracks 1. A wheel detector 4 aligned with the camera 5 optical axis can send signals to the control computer 3 to determine which car is passing by camera 5. The camera's field of view 6 captures images of the passing railroad cars. An optional coupler gap detector system 1001 consists of a laser 8 sending a signal to a receiver 10 which signals the control computer 3 when the gap between the cars is aligned with the camera 5. System 1002 consists of a railroad car radio identification tag reader and a railroad car wheel detector and is used to associate image frames with the proper cars. A screen or wall 7 has a light source of some type thereby functioning to contrast the image of the coupler gap, especially the air hose, against the white, lighted screen or wall 7.

When a low air hose is detected by the computer 3, an alert can be sent remotely via phone, internet or microwave link 320.

Figure 2:
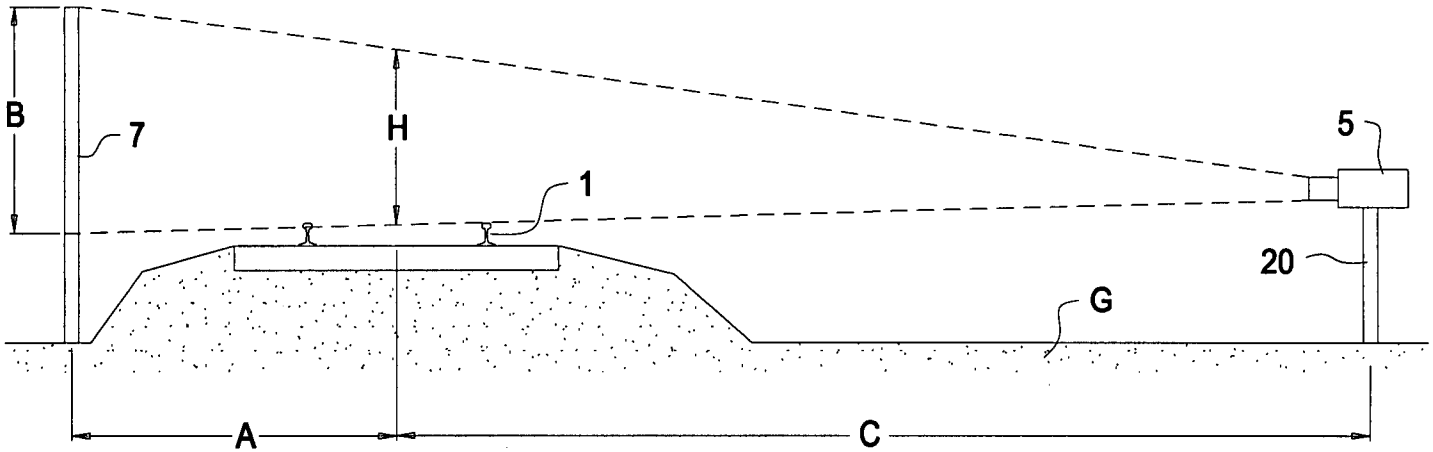
FIG. 2 is a side plan view of a the air hose height detection system.

Referring next to FIG. 2 the camera imaging system consists of camera 5 in a weatherproof enclosure mounted on a post 20 opposite an illuminated screen or wall 7. The camera's optical axis is aligned perpendicular to the track 1. Typical dimensions are A=10', B=6', C=27', and H=4.4' (midline of track camera field of view height). The dimensions may vary depending on the camera/lens characteristics and the desired field of view.

Figure 4:
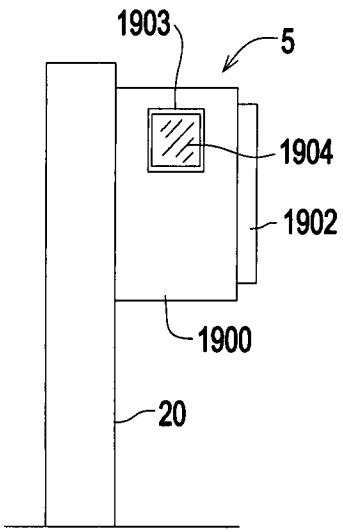
FIG. 4 is a front plan view of the camera enclosure.
Figure 3:
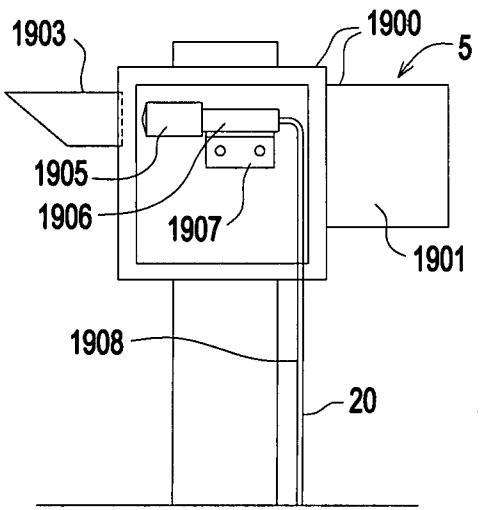
FIG. 3 is a side plan view of the camera enclosure.

Referring next to FIGS. 3,4 the camera 5 has a weatherproof housing 1900. The inside environment of the housing 1900 is controlled by an enclosure climate control unit 1901. In FIG. 3 the enclosure door 1902 is removed. The camera window hood 1903 protects the camera window 1904 which may be a clear acrylic. The CCD camera 1906 has a lens 1905. A mounting bracket 1907 supports the camera/lens 1905/1906. A cable 1908 carries power and signal lines. The housing with openings is weatherproof.

Figure 5:
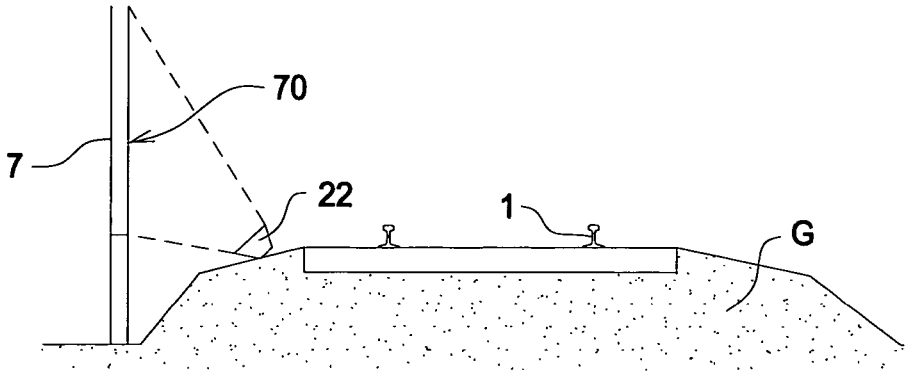
FIG. 5 is a side plan view of a screen lit up by a front searchlight.

Referring next to FIG. 5 the searchlight 22 lights the front 70 of back light screen or wall 7 in the first method of illumination.

Figure 6:
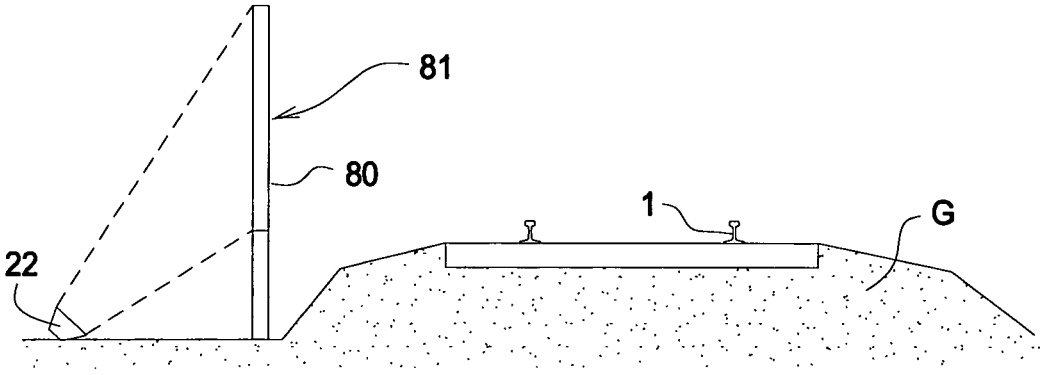
FIG. 6 is a side plan view of a screen lit up by a rear searchlight.

In FIG. 6 the back light screen 80 is transparent or translucent so that searchlight 22 lights the front 81 of screen 80 through the back of the screen in the second method of illumination.

Figure 7:
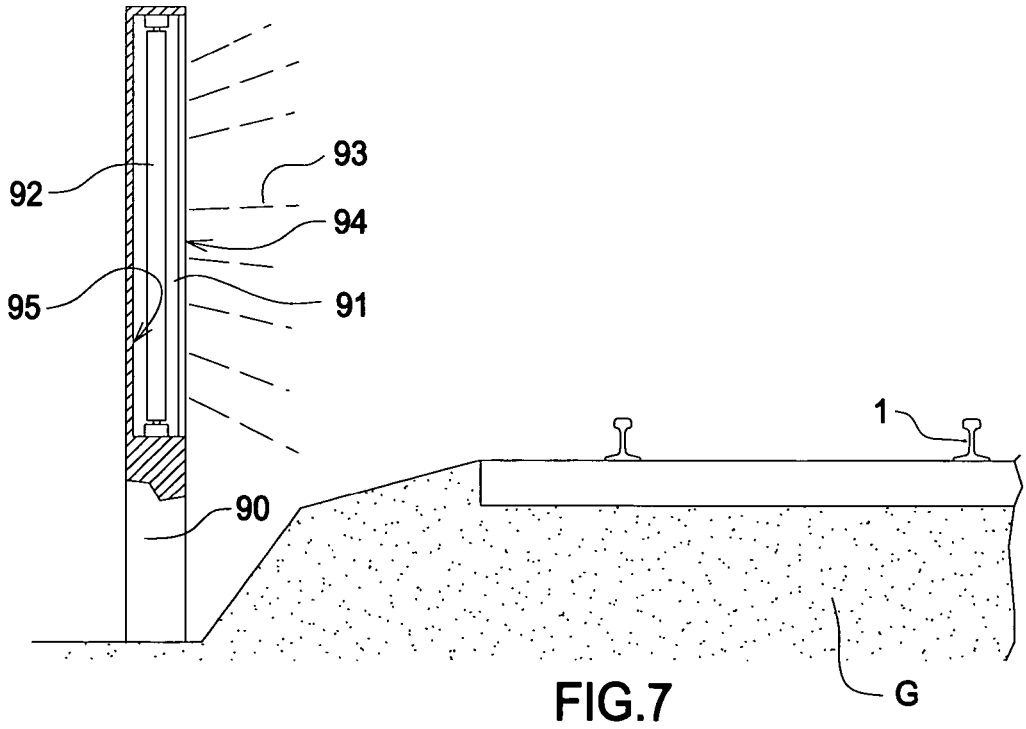
FIG. 7 is a side plan view of a screen having internal bulbs.

In FIG. 7 the back light screen 90 is a light box with a hollow 91, a bulb 92, a transparent or translucent front 94 allowing light rays 93 through in the third method of illumination. The back 95 of the inside hollow 91 can be white or reflective.

Figure 8:
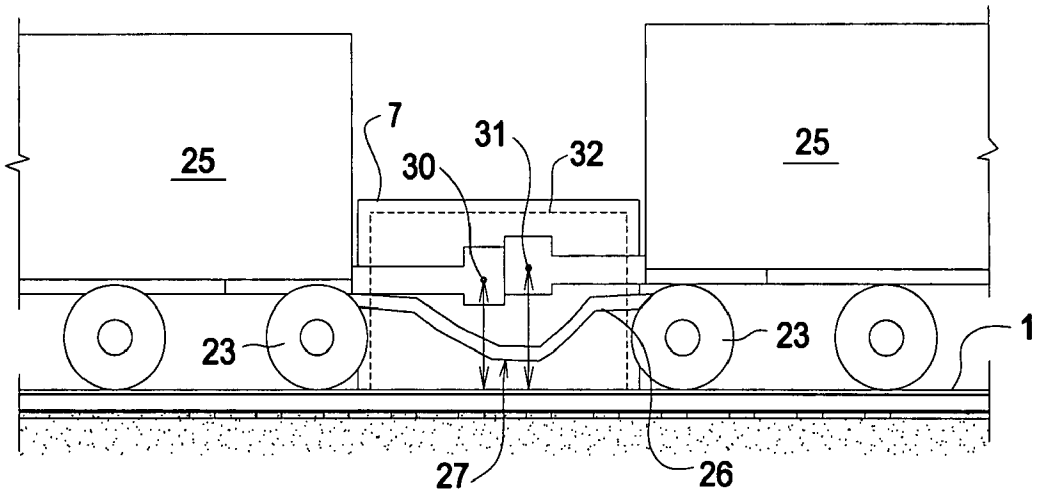
FIG. 8 is a side view of the coupler gap area between cars.

Referring next to FIG. 8 the side view of a coupler gap between adjacent cars is shown. The cars are comprised of car bodies 25 and wheels 23 that are coupled together with couplers 30, 32. The air hose 27 on the left car couples to the air hose 26 on the right car. The camera's field of view 32 encompasses the coupler gap area containing the items of interest; air hoses 26, 27 and couplers 30, 31. The camera's field of view 32 is illuminated by the back lit screen or wall 7 to provide a high contrast between the relatively dark air hoses and couplers in the foreground and the bright background.

As the train moves between the camera 5 and back light screen or wall 7 different parts of the cars 25 come into the camera's field of view and are imaged. Because only images of the coupler gaps are desired the invention employs one of three methods to signal the image acquisition and computer control programs when a coupler gap is present in the camera's field of view.

Figure 9:
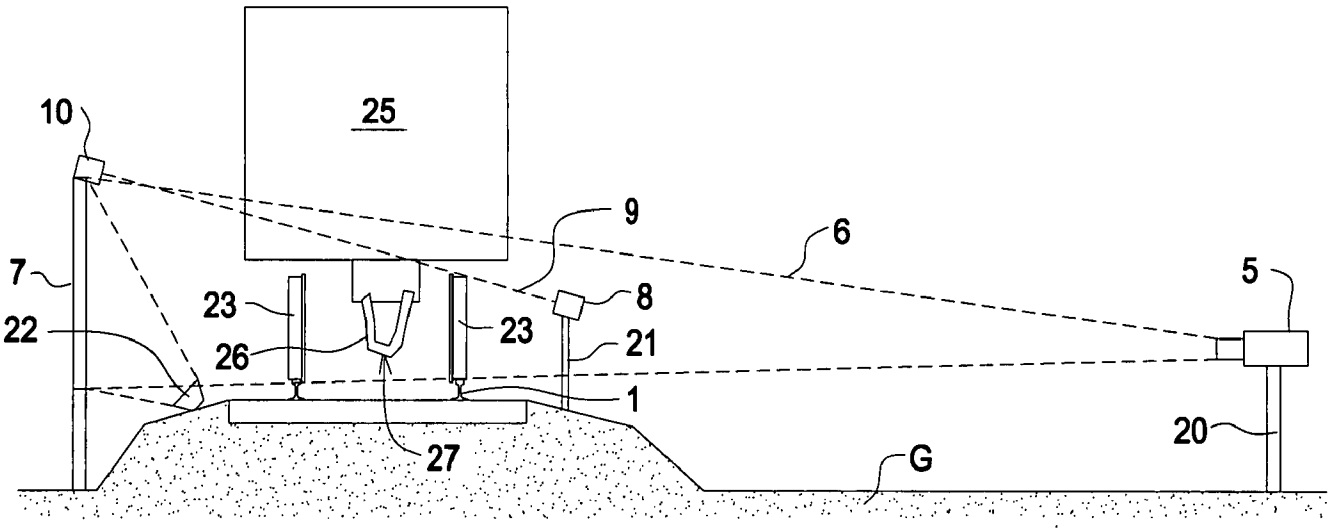
FIG. 9 is a front plan view of the air hose height detection system, the coupler gap detector and a car with air hose assembly.

Referring next to FIG. 9 the first of three methods of detecting the coupler gaps between adjacent cars and signaling the camera imaging system is shown. Laser transmitter 8 projects a laser beam 9 onto a receiver 10 at an angle. The laser 8, laser beam 9 and receiver 10 are aligned with the camera's field of view 6. The laser beam 9 is normally blocked when a car body 25 is present in the camera field of view. However, when a coupler gap between adjacent cars moves in to the camera's field of view 6 the laser beam 9 from laser 8 reaches the receiver 10 and a voltage signal is generated that signals the camera imaging system to acquire the current image frame for processing. This first method is the most reliable at detecting the coupler gaps but needs periodic cleaning and alignment of the laser 8 and receiver 10 that is difficult to accomplish at remote locations on a railroad.

Figure 10:
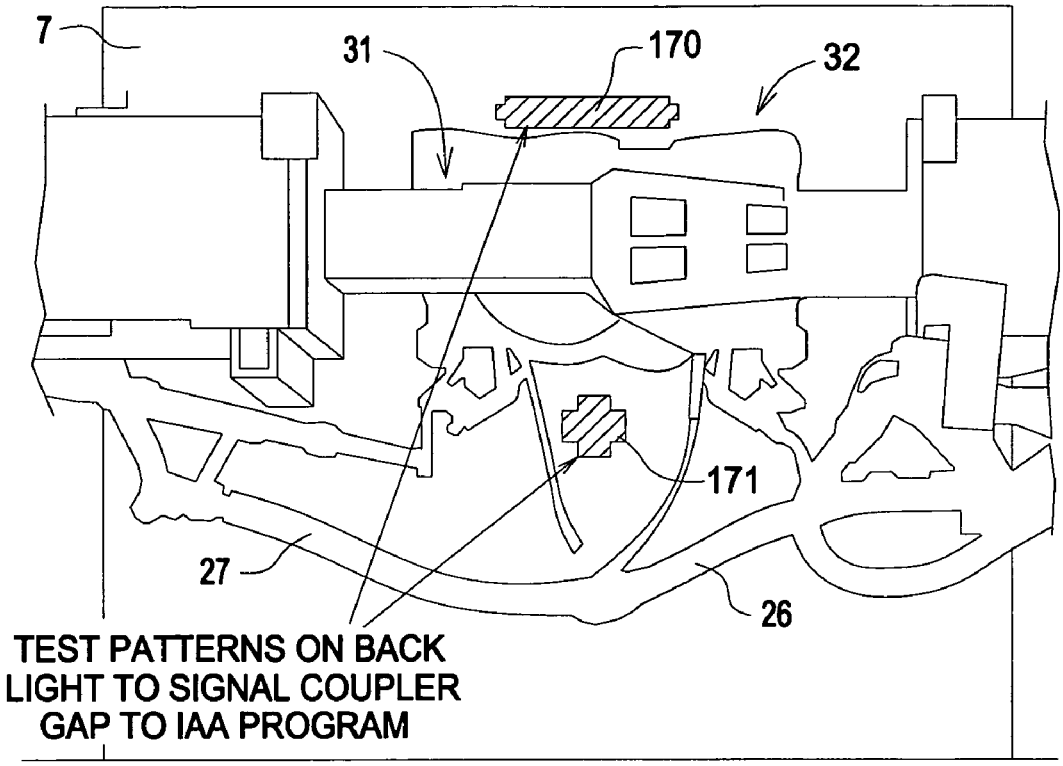
FIG. 10 is a side view showing the camera's perspective of the back light screen or wall with applied test patterns for identifying a coupler gap.

Referring next to FIG. 10 the second of three methods of detecting the coupler gaps between adjacent cars and signaling the camera imaging system is shown. FIG. 10 shows the camera's perspective of a coupler gap area with the back light screen or wall 7 behind. Test patterns 170,171 are applied to the back light screen or wall 7 as shown. These test patterns are positioned on the back light screen or wall such that they are only visible in the image frame when a coupler gap is present. The view of the test patterns is blocked when any other part of the car is in the field of view. The image acquisition and analysis program contains algorithms that search the current image frame for the test patterns. If these are found then the image is acquired and processed. This second method reliably signals the image acquisition and analysis program that a coupler gap is present without the need of a distinct coupler gap detector that requires periodic maintenance. However, this method has the disadvantage that in rare cases the test patterns interfere with the detection and measurement of the air hose assembly 26,27 or the couplers 30,31.

Figure 11:
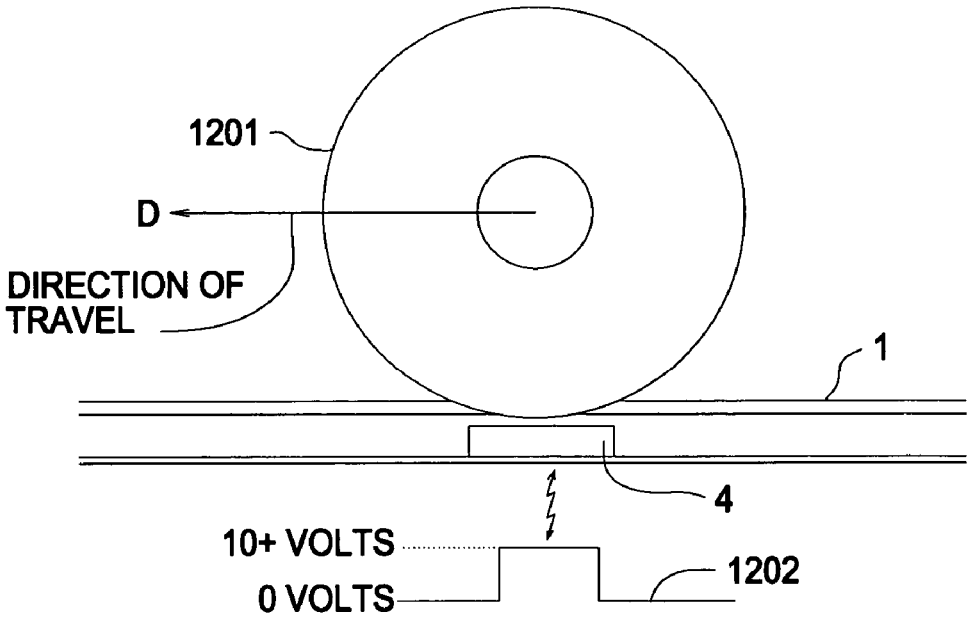
FIG. 11 is a side plan view of a wheel detector with a wheel passing over and corresponding voltage signal.
Figure 12:
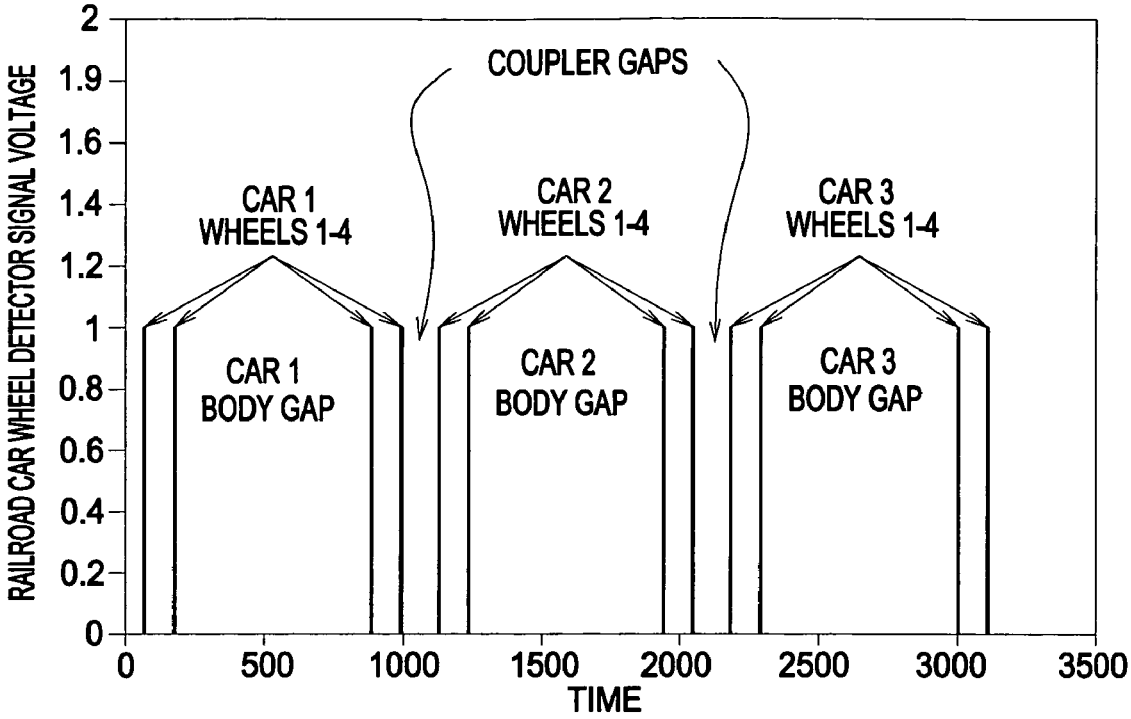
FIG. 12 is a graph of wheel detector voltage signals plotted against time for a typical train.

Referring next to FIGS. 11, 12 the third of three methods of detecting the coupler gaps between adjacent cars and signaling the camera imaging system is shown. The wheel detector 4 is mounted on the track 1 and outputs a voltage signal that rises when a wheel D passes over the detector. The wheel detector voltage signal is recorded continuously along with timing references by the image acquisition and control computer 3 in FIG. 1. This produces a time-varying pattern of voltage pulses as shown in FIG. 12. The unique pattern of voltage pulses associated with coupler gaps between adjacent cars is clearly seen in FIG. 12. The automatic system control program applies a pattern recognition algorithm to the wheel detector voltage signal to identify the time indices associated with these coupler gaps. The automatic system control program then screens the air hose height measurements obtained from the imaging acquisition and analysis program and retains only the air hose and coupler height measurements occurring within the coupler gap timing indices. This third method reliably signals the image acquisition and analysis program that a coupler gap is present without the need of a distinct coupler gap detector that requires periodic maintenance. However, this method requires the automatic system control program to correctly identify coupler gaps based on pattern recognition of the wheel detector voltage signals, which is not as reliable as the first or second methods.

Figure 13:
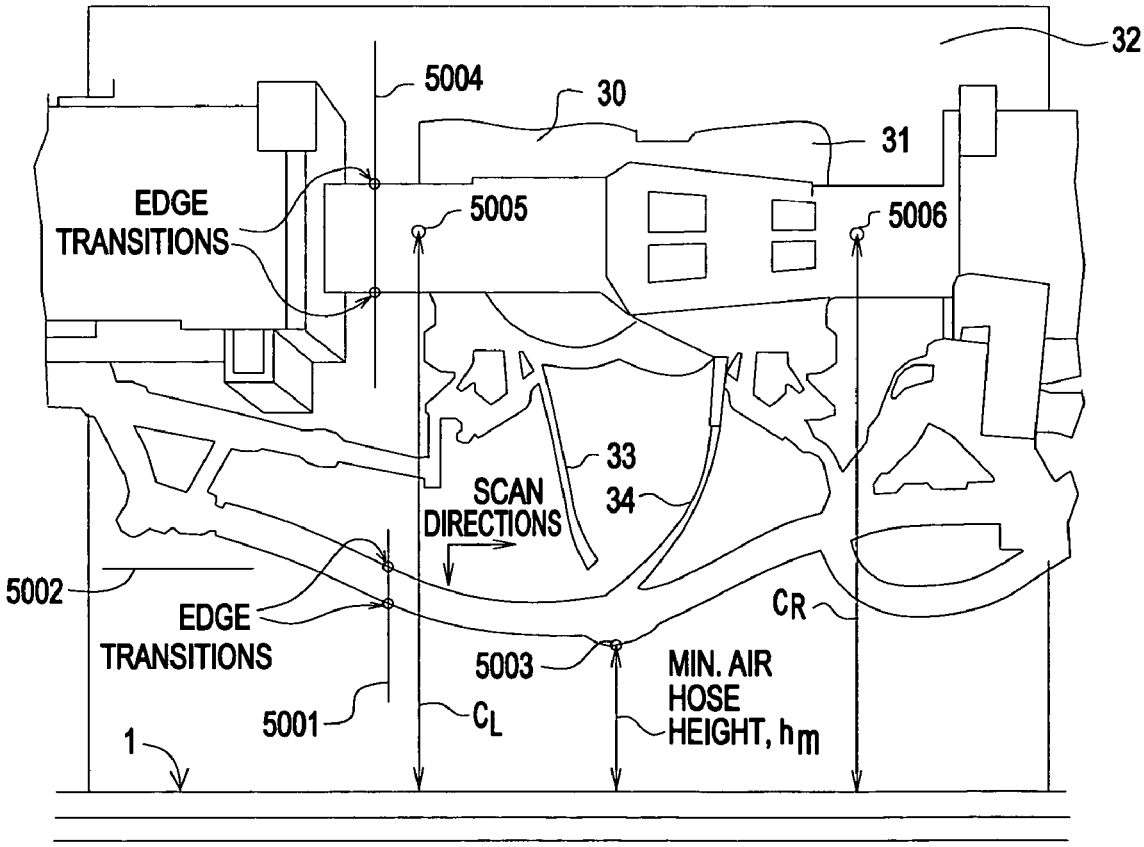
FIG. 13 is a view of a camera image frame containing the image analysis tools used to identify air hoses and couplers and measure their heights above the top edge of the rail

Referring next to FIG. 13 the camera's perspective of the coupler gap area between adjacent cars is shown. The image frame 32 contains images of the air hose assembly 26, 27 and the left and right couplers 30, 31. The acquired image is analyzed by the image acquisition and analysis program using the following method:

1. The image frame is scanned for the image of an air hose using a vertical line edge finder tool 5001. The tool is initially placed in the upper left corner of the image frame and is then moved horizontally and vertically across the image and the distances between dark/light and light/dark edge transitions are calculated.

2. The number of edge/edge distances falling within the specified range for an air hose width are tallied. Smaller objects such as straps 33,34 are ignored.

3. If the tally of edge/edge distances exceeds a specified target value then the shape is determined to be an air hose assembly image.

4. If the vertical line edge finder tool 5001 completes its scan of the image frame and the tally of edge/edge distances does not exceed the specified target value then a horizontal line edge finder tool 5002 is applied to the center left of the image and the scan repeated. This is necessary because air hoses can have primary vertical or horizontal orientations.

5. Once an air hose shape is found the lowest point of the contiguous air hose shape blob 5003 is found using an image analysis tool.

6. The straight line corresponding to the top edge of the rail 1 is found using an image analysis tool.

7. The vertical distance $h_{min}$ from the top edge of the rail 1 and the lowest point on the air hose shape blob 5003 is calculated in pixels using an image analysis tool.

8. The image analysis program applies a vertical line edge finder tool 5004 centered horizontally above the lower point of the air hose shape blob 5003 and begins to scan the image frame for coupler images.

9. The coupler vertical line edge finder tool 5004 is moved to the left and the distance between light/dark and dark/light edge transitions calculated.

10. The number of edge/edge distances falling within the specified range for a coupler shank 30 are tallied. Objects larger or smaller than this range are ignored.

11. If the tally of edge/edge distances exceeds a specified target value then the shape is determined to be a left coupler shank 30.

12. If a left coupler is found or the coupler vertical line edge finder tool 5004 completes its scan of the image frame to the left and the tally of edge/edge distances does not exceed the specified target value then the tool is reset to the starting position and a scan to the right is initiated and steps 9-11 repeated.

13. Once left 30 and right coupler 31 are found in the image frame the horizontal centers of the shanks 5005,5006 are identified with an image analysis tool.

14. The vertical distances $c_L$, $c_R$ between the top edge of the rail 1 and the left and right coupler center heights are calculated in pixels.

15. Scale factors are applied to the pixel values of the air hose assembly minimum height and the coupler center heights to convert these values to inches above the top of rail. The pixels/inch scale factors are obtained in a calibration procedure in which a scale calibrated in inches is attached to the center of the track and oriented vertically with "0" inches on the scale corresponding to the top of the rails. An image is acquired with the camera 5 and the scaling obtained by comparing the inch readings on the scale to their vertical pixel positions in the camera image frame.

Referring next to FIG. 14 a sample air hose/coupler height output file is shown. The automatic system control program generates this type of report from the railroad car identification data and air hose/coupler height measurements for each train and transmits an electronic version of this file to the appropriate locations on the railroad communication network.

Referring next to FIG. 15 a sample low air hose warning is shown. The automatic system control program generates this type of warning for any air hose heights below the minimum allowable level and transmits an electronic version of this file to the appropriate locations on the railroad communication network.

Referring next to FIG. 16A, 16B, 16C, 16D the program logic flow chart for the invention with the first method of detecting coupler gaps (laser/receiver coupler gap detector) is shown. The logic flow sequence corresponding to this flow chart is described herein:

1. The automatic system control (ASC) program (block 1100) continuously monitors the train presence detectors at the edges of the test zone (block 1101).

2. When a train passes over the train presence detectors 2 in FIG. 1, voltage signals are produced by the passing wheels that are recognized by the ASC program (block 1102 and FIGS. 10,11).

3. The ASC program activates the image lighting system block 1103, coupler gap detector (if so equipped block 1104) and internally signals the image acquisition/analysis (IAA) program to begin operation (block 2100).

4. The IAA program optimizes the camera exposure setting for the current illumination conditions of the camera imaging back light (block 2102).

5. The IAA program monitors the coupler gap detector for a low signal indicating that the first railroad car has arrived at the camera imaging field of view (block 2103).

6. The IAA program begins acquiring images of the railroad cars passing through the camera imaging field of view (block 2104).

7. The IAA program continues to monitor the coupler gap detector signal for a high signal indicating that a coupler gap is in the camera imaging field of view (blocks 2109,2103).

8. When it detects a high signal the IAA scans the coupler gap image (reference FIG. 13)for an air hose (block 2105) using the following technique:

a. The IAA program applies a vertical line "edge finder" tool 5001 to the center left of the coupler gap image 32.

b. The vertical line edge finder tool 5001 detects the locations of dark-to-light and light-to-dark edge transitions along its length.

c. The distances between successive dark-to-light and light-to-dark edge transitions are calculated and compared to the pre-set air hose width range.

d. If an edge-edge transition distance falls within the air hose width range, then the air hose segment counter is incremented by 1 (block 2106).

e. The vertical line edge finder tool 5001 is moved horizontally to the right and Steps b-d are repeated.

f. When the vertical line edge finder tool 5001 reaches the right edge of the image frame 32, it is moved down and back to the left edge and the scan repeated until the bottom right corner of the image is reached or an air hose assembly 26,27 is detected (block 2105).

g. An air hose assembly 26,27 is detected when a sufficient number of hose segments have been tallied (block 2106).

h. If an air hose assembly 26,27 is not found in the vertical line edge finder tool scan, then a scan is performed with a horizontal line edge finder tool 5002 (block 2105) because air hose assemblies can have a primary vertical or horizontal orientation.

9. When an air hose assembly image blob is found, the IAA program applies an image analysis tool to find the lowest point on the blob 5003 and then measures the vertical distance between the lowest point of the air hose assembly image and the top edge of the rail in pixels(block 2106).

10. The IAA program scans the current image for coupler images 31,32 (block 2107). The scan technique:

a. A vertical edge finder tool 5004 is applied to the image centered above the lowest point of the air hose assembly 5003 as previously found in (9).

b. The vertical edge finder tool detects dark-to-light and light-to-dark edge transitions along its length (block 2107).

c. The distances between successive dark-to-light and light-to-dark edge transitions are calculated and compared to the pre-set coupler width range (block 2107).

d. If an edge-edge transition distance falls within the coupler shank width range, then the coupler shank segment counter is incremented by 1 (block 2107).

e. The vertical line edge finder 5004 is moved horizontally to the left and Steps b-d are repeated.

f. A coupler shank is detected when a sufficient number of segments have been tallied (block 2107).

g. Once the left coupler 30 is found or when the vertical edge finder tool 5004 reaches the left edge of the image, the tool is relocated to the starting position and a scan to detect the right coupler 31 is initiated (block 2107).

11. When coupler images are found, the IAA program uses an image analysis tool to find the vertical center of their shanks 5005, 5006 and then measures the height between the coupler shank mid-point above the top edge of the rail in pixels $c_L$, $c_R$ (blocks 2108).

12. The IAA program resets itself and waits until the coupler gap detector signals that another coupler gap is present (block 2109) and then Steps 6-11 are repeated.

13. Concurrent with the IAA program operation, the ASC program continues to monitor and record the wheel voltage pulses and railroad car radio tag identification signals from system 1002 in FIG. 1 (blocks 1104,1106).

14. The ASC program (block 1100) monitors the train presence detector signals (2 in FIG. 1) to determine when a sufficient length of time without a voltage signal indicates that the train has left the test zone (block 1107).

15. The ASC program (block 1100) converts the air hose assembly minimum height $h_{min}$ and coupler center height measurements $c_L$ and $c_R$ from pixels to inches using the previously determined scale factors.

16. The ASC program merges the air hose and coupler height data with the railroad car identification system data and stores in an electronic file for subsequent electronic transmission (block 1108 and FIG. 13).

17. The ASC program (block 1100) generates an electronic report file of any railroad cars that were found to have air hose assemblies lower than the minimum limit or with couplers outside of the prescribed height variation limits (block 1109 and FIG. 14).

18. The ASC program (block 1100) transmits these files to the appropriate railroad communication network destinations (block 1109).

19. The ASC program (block 1100) deactivates the car radio tag identification reader (11 in FIG. 1) and returns to Step 1 (block 1110).

Figure 16A:
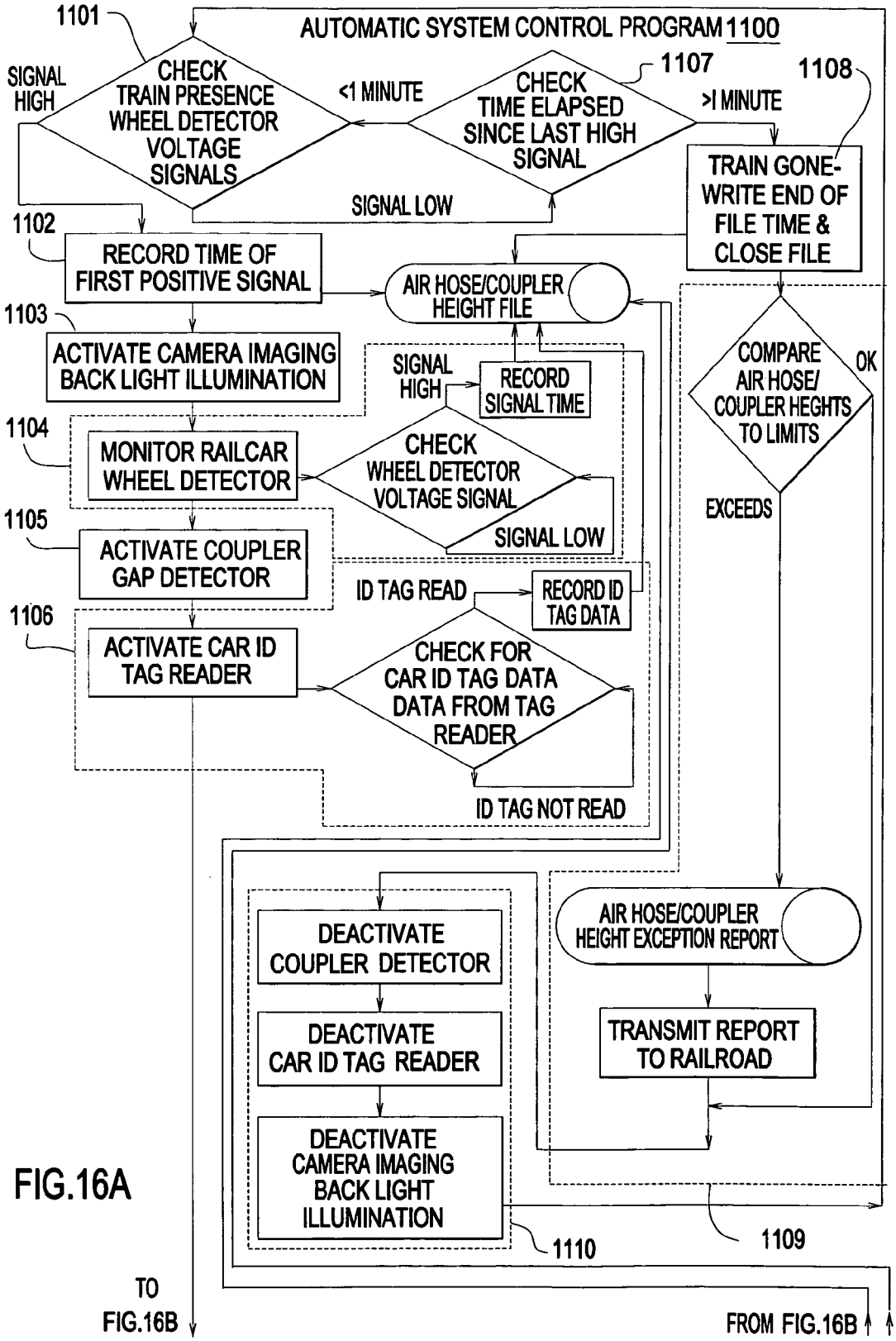
FIGS. 16A, 16B, 16C, 16D are a logic flow chart of the program that detects air hoses and couplers and measures their heights using the first method of detecting coupler gaps.
Figure 16B:
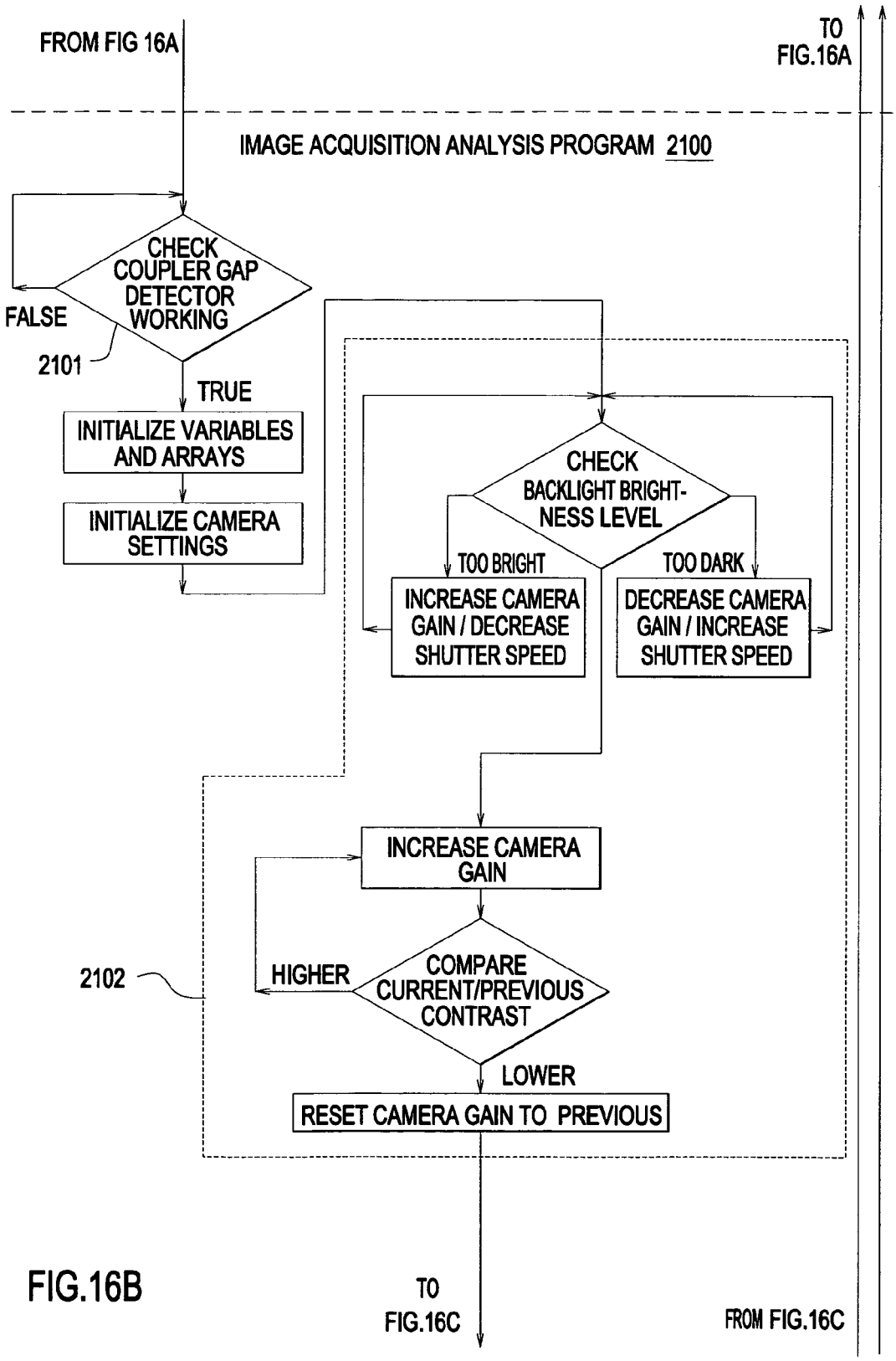
Figure 16C:
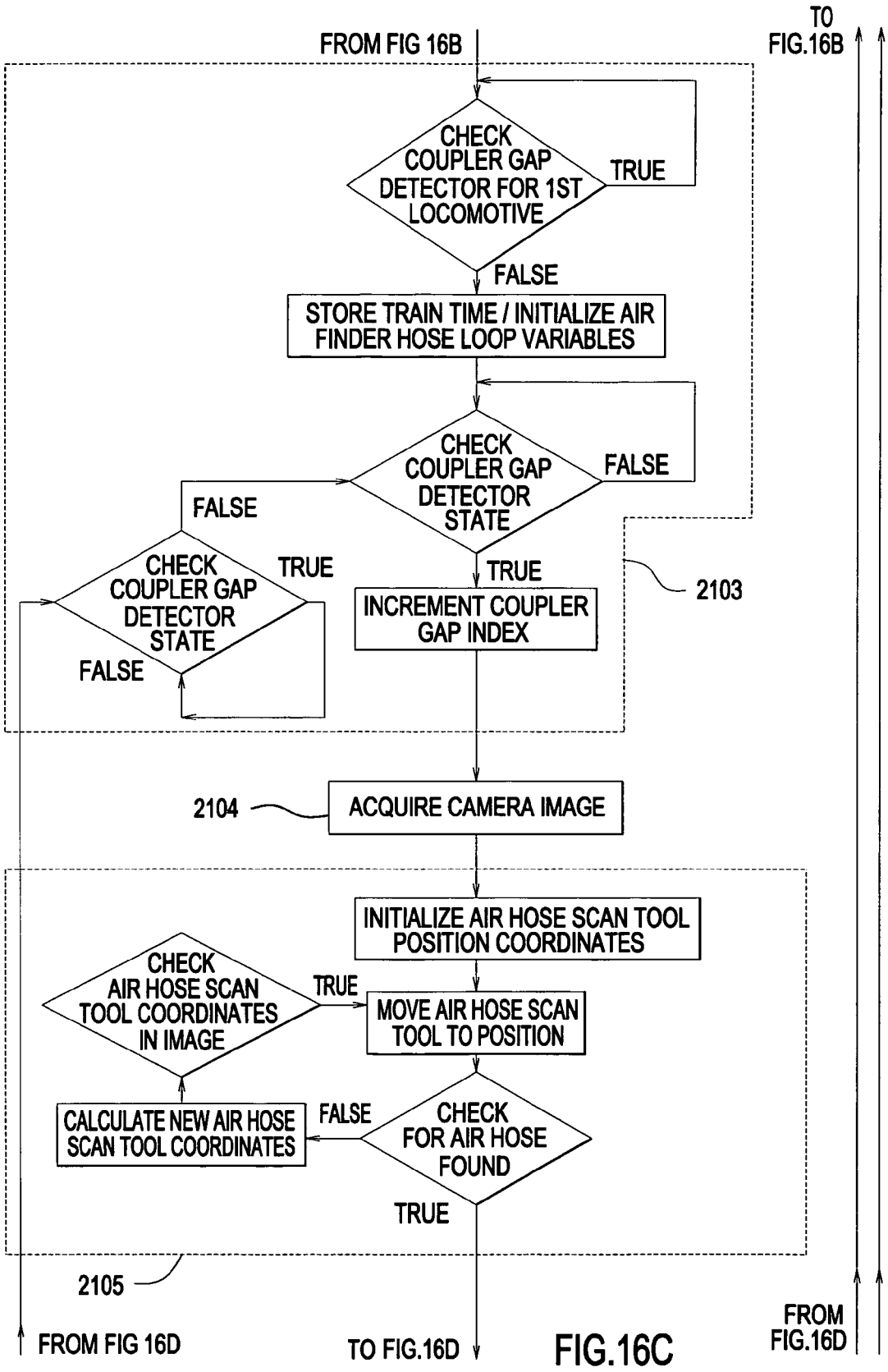
Figure 16D:
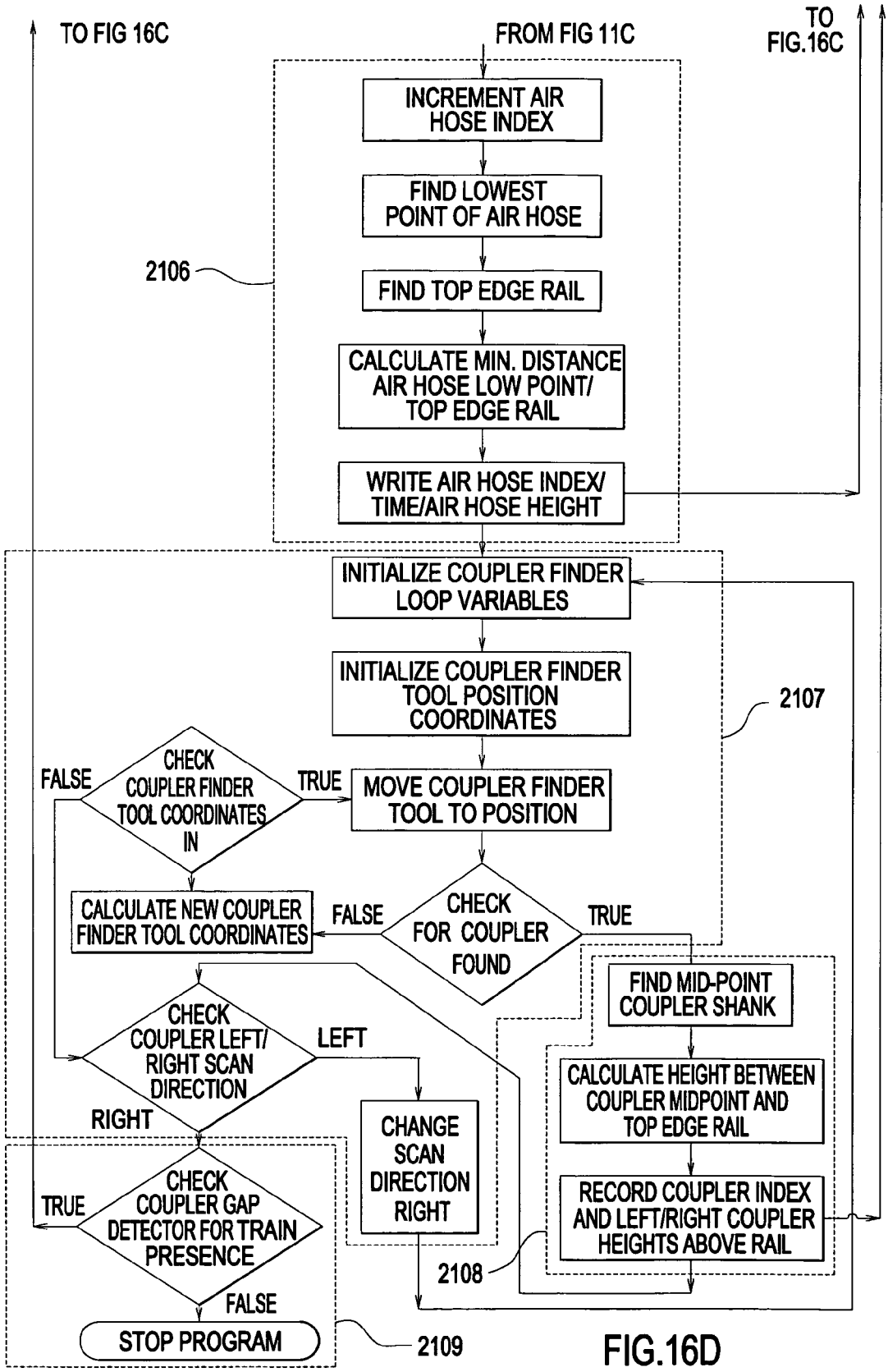
Figure 16E:
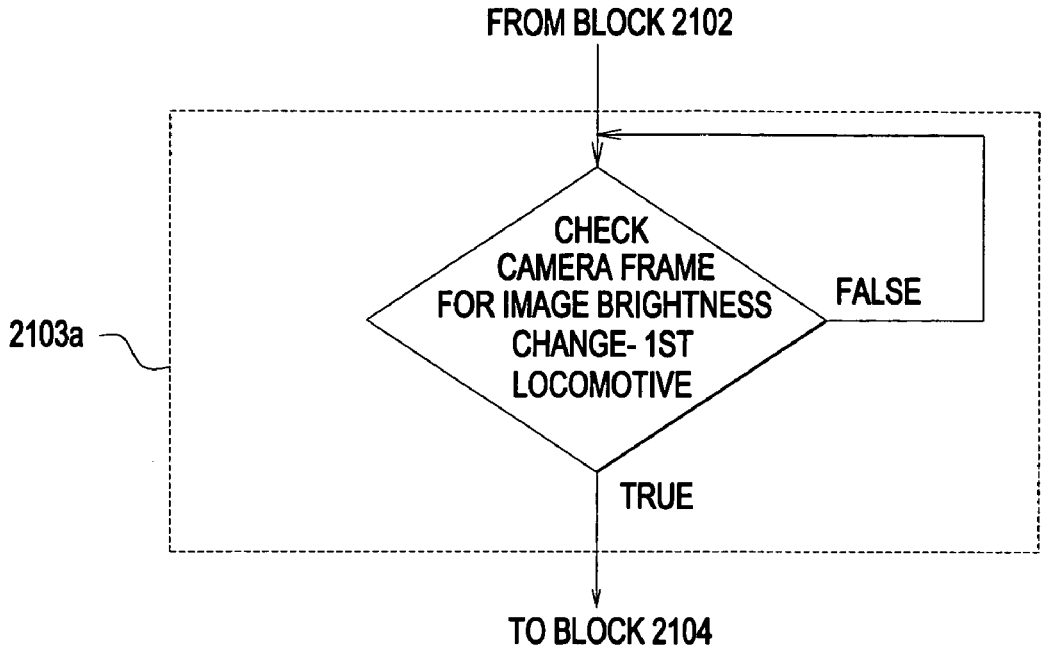
FIG. 16E, 16F are flow chart modifications for the program that uses the second method of detecting coupler gaps.
Figure 16F:
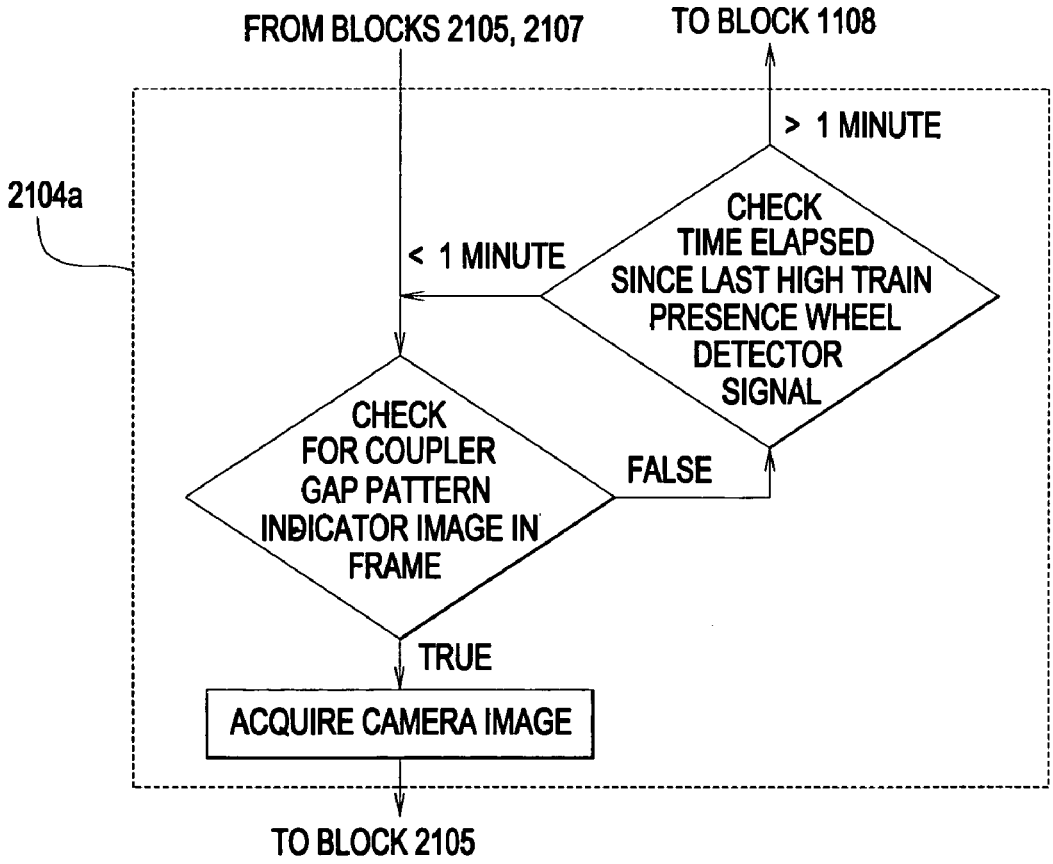

Referring next to FIGS. 16E, 16F the modifications to the program logic flow chart of 16A, 16B,16C, 16D that are necessary for the invention with the second method of detecting coupler gaps are shown. This second method does not incorporate a distinct coupler gap detector (system 1001 in FIG. 1) but instead detects the coupler gaps by the detection of test patterns on the back light screen or wall in the current image frame by the IAA program. Accordingly, the program logic flowchart is modified as described below:

1. Block 1105 (activate coupler gap detector)is eliminated because there is no coupler gap detector to activate.

2. Block 2103 is replaced with block 2103*a* in FIG. 16E because there is no coupler gap detector to-signal the presence of the first locomotive in the train. Instead, an algorithm operates in block 2103*a* that monitors the current camera image frame brightness. This algorithm detects when the brightness changes-dramatically from one camera image frame to the next when the relatively bright frame of only the illuminated back light or wall is succeeded by a relatively dark frame corresponding to the first locomotive of the train entering the camera's field of view.

3. Block 2104 is replaced with block 2104*a* in FIG. 16F because there is no coupler gap detector to signal the passage of the train. Instead, an algorithm operates in block 2104*a* that searches for the test patterns in the current frame. If the test pattern image is not found then the algorithm checks the elapsed time between wheel voltage pulses. If the elapsed time exceeds 1 minute then the algorithm determines that the train has left the zone and continues to block 1108 to complete the data analysis. Otherwise the algorithm proceeds to acquire the current camera image.

4. Program flow proceeds from the "check air hose scan tool coordinates in image" FALSE branch in block 2105 to block 2104*a* because the "check coupler gap detector state" block in 2103 has been eliminated. Instead the program flow proceeds from the end of the image scan for air hose block 2105 to the replacement block 2104*a* (FIG. 16F and described in (3) above).

5. Block 2109 is eliminated because there is no coupler gap detector. Instead, program flow proceeds from "check coupler left/right scan direction" RIGHT in block 2107 to block 2104*a* (FIG. 16F and described in (3)).

6. The "deactivate coupler gap detector" block is eliminated from block 1110 because there is no coupler gap detector.

Figure 16G:
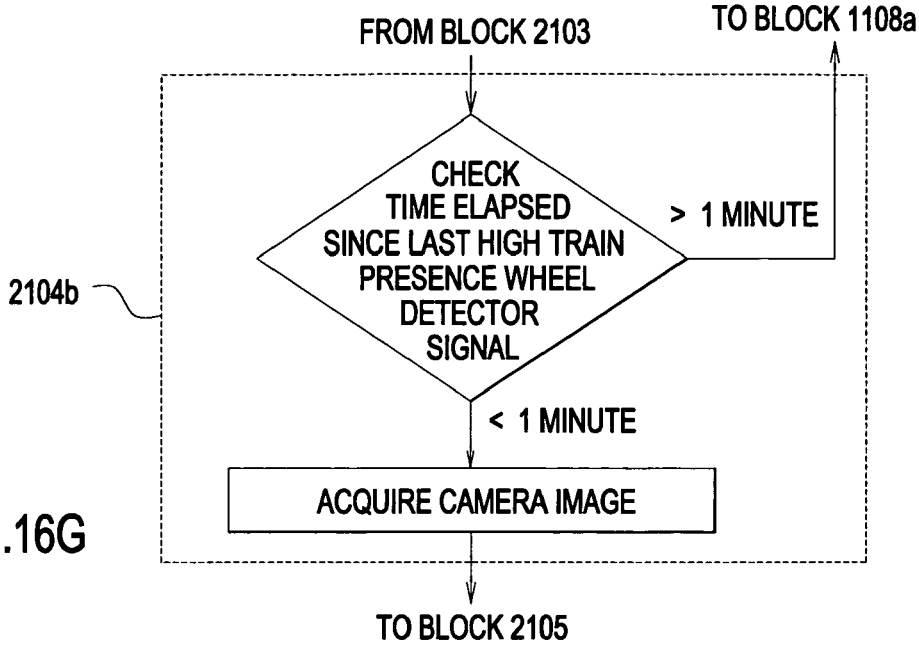
FIG. 16G, 16H are flow chart modifications for the program that uses the third method of detecting coupler gaps.
Figure 16H:
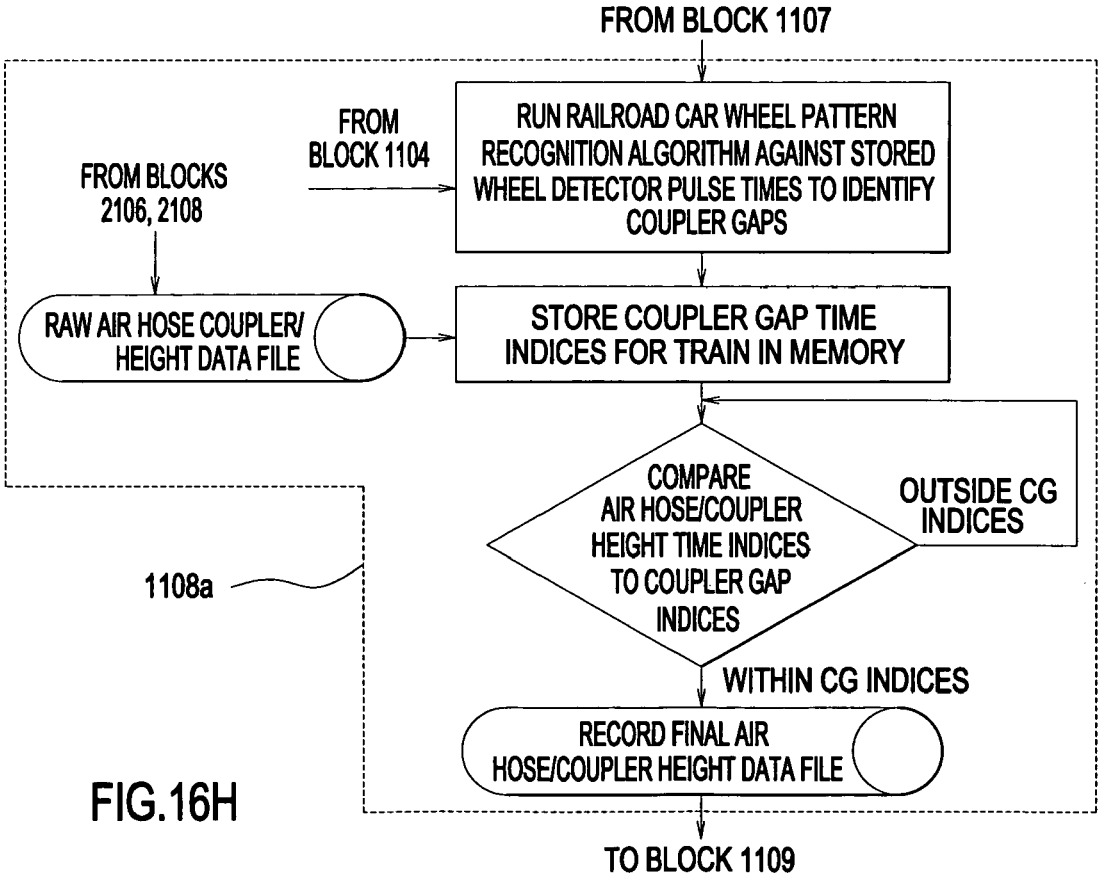

Referring next to FIGS. 16E, 16G, 16H the modifications to the program logic flow chart of 16A,16B,16C, 16D that are necessary for the invention with the third method of detecting coupler gaps are shown. This third method does not incorporate a distinct coupler gap detector (system 1001 in FIG. 1) but instead detects the coupler gaps by the pattern of railroad car wheel detector timing references as identified by the railroad car wheel detector (4) in system 1002. Accordingly, the program logic flowchart is modified as described below:

1. Block 1105 (activate coupler gap detector)is eliminated because there is no coupler laser/receiver gap detector to activate.

2. Block 2103 is replaced with block 2103*a* in FIG. 16E because there is no coupler gap detector to signal the presence of the first locomotive in the train. Instead, an algorithm operates in block 2103*a* that monitors the current camera image frame brightness. This algorithm detects when the brightness changes dramatically from one camera image frame to the next when the relatively bright frame of only the illuminated back light or wall is succeeded by a relatively dark frame corresponding to the first locomotive of the train entering the camera's field of view.

3. Block 2104 is replaced with block 2104*b* in FIG. 16G because there is no coupler gap detector to signal the passage of the train. Instead, an algorithm operates in block 2104*b* that monitors the voltage pulses from the train presence detectors ((2) in FIG. 1) and counts the elapsed time between wheel voltage pulses. If the elapsed time between wheel voltage pulses exceeds 1 minute then the algorithm determines that the train has left the zone and continues to block 1108*a* in FIG. 16H to complete the data analysis. Otherwise the algorithm proceeds to acquire the current camera image.

4. Program flow proceeds from the "check air hose scan tool coordinates in image" FALSE branch in block 2105 to block 2104*b* because the "check coupler gap detector state" block in 2103 has been eliminated. Instead the program flow proceeds from the end of the image scan for air hose (block 2105) to the replacement block 2104*b* (FIG.16G and described in (3) above).

5. Block 2109 is eliminated because there is no coupler gap detector. Instead, program flow proceeds from "check coupler left/right scan direction" RIGHT in block 2107 to block 2104*b* (FIG. 16G and described in (3) above)).

6. Block 1108 is replaced with 1108*a* in FIG. 16H. Block 1108*a* contains an algorithm that compares the air hose time indices from the IAA program to the coupler gap time indices as recorded by the ASC program from the wheel detector voltage pulses. Only air hose/coupler height readings with time indices between a pair of coupler gap time indices are retained and recorded in the Air Hose/Coupler Height Data File (FIG. 14).

7. The "deactivate coupler gap detector" block is eliminated from block 1110 because there is no coupler gap detector.

Preferred Embodiment of the Invention

The invention is composed of the components arranged as shown in FIG. 1 and consisting of:

1. Automatic computerized image acquisition/control system (3)

2. Charge Coupled Device (CCD) camera with lens in a weatherproof enclosure (5)

3. Frame grabber camera interface in the data collection system (300)

4. Camera/frame grabber electrical cable (310)

5. Railroad car identification system (1002), comprised of a wheel detector (4) and a radio identification tag reader (11)

6. Laser/receiver "coupler gap" detector (1001)

7. Illuminated camera imaging back light or wall(7)

8. Communication link (320)

Below are the preferred configurations of the camera, lens, camera imaging back light and illumination. Other configurations would work as well for different camera-to-track distances, lens focal lengths, larger back lights, etc.

1. Camera: Electronic CCD camera with programmable electronic gain and shutter speed, ⅓" CCD element, CS lens mount, minimum 30 frames/second scan rate.

2. Lens: Fixed or Variable Focal Length set at 20 mm, CS mount.

3. Camera Orientation and Location: Optical axis perpendicular to railroad track and set back 27' from track centerline.

4. Illuminated Back Light or wall: 6' high by 8' long set back 10' from track centerline opposite side of track from camera, bottom edge aligned slightly below top edge of rail in FOV, flat white surface coating, illuminated by at least 1000 watts of incandescent lighting.

5. Camera/Railroad Track Orientation: Railroad track should run as close to due east-west as possible at the location of the camera to avoid problems with fore-lighting of the train and back light shadowing in the early morning or late afternoon hours.

Although the present invention has been described with reference to preferred embodiments, numerous modifications and variations can be made and still the result will come within the scope of the invention. No limitation with respect to the specific embodiments disclosed herein is intended or should be inferred. Each apparatus embodiment described herein has numerous equivalents.

We claim:

1. A method to detect a low or broken air hose between passing cars of a railroad train, the method comprising:

providing a light uniform backgound parallel to a railroad track at a chosen distance away from the railroad track;

mounting a camera on an opposite side of the railroad track;

aiming the camera at the light uniform background;

capturing an image of a gap between two railroad cars; and using a machine vision algorithm to detect a low or broken air hose.

2. The method of claim 1 including the step of using a laser based gap detector to coordinate the capturing of an image.

3. The method of claim 1 including the step of transmitting an alarm signal when a low or broken air hose is detected.

4. The method of claim 1 including the step of using a searchlight aimed at a front of a screen for lighting the screen as the means for providing a light uniform background.

5. The method of claim 1 including the step of using a searchlight aimed at a back of the screen for lighting a screen as the means for providing a light uniform background.

6. The method of claim 1 including the step of using a light box for a screen as the means for providing a light uniform background.

7. The method of claim 1 including the step of using a control computer to capture the image of a gap, and to execute the machine vision algorithm using a vertical line shape edge finder tool.

8. The method of claim 7 including the step of using a train presence wheel sensor and a wheel counter to determine which car has a low or broken air hose.

9. The method of claim 1 including the step of using an algorithm to detect a height of a car coupler.

10. The method of claim 1 including the step of using pattern recognition techniques on a sequence of voltage pulses corresponding to a wheel position of the railroad cars in the train to detect the gaps.

11. The method of claim 1 using specific image patterns generated by the light uniform background that are recognized by the vision algorithm to identify the gap.

12. The method of claim 7 including the step of using a railroad car radio identification tag reader and a wheel counter to determine which gap has a low or broken air hose.

13. The method of claim 1, wherein the light uniform background further comprises a background object of uniform light appearance, including a side of a building or a wall.

14. The method of claim 7, wherein the vertical line shape edge finder tool includes a step of moving a vertical line shape edge finder tool horizontally and vertically across the gap image to detect an air hose in the image by a predetermined width dimension of the air hose.

15. The method of claim 9, wherein the algorithm includes a step of moving a vertical line shape edge finder tool horizontally and vertically across the gap image to detect coupler shanks in the image by their predetermined height dimension.

16. A method to detect a low or broken air hose between passing cars of a railroad train, the method comprising:

selecting a planar structure parallel to a railroad track at a chosen distance away from the railroad track;

providing light to the planar structure;

mounting a camera on an opposite side of the railroad track;

aiming the camera at the planar structure;

capturing an image of a gap between two railroad cars; and using a machine vision algorithm to detect a low or broken air hose.

17. A system to detect a low or broken air hose between passing cars of a railroad train, the system comprising:

means for providing a light uniform background parallel to a railroad track functioning to provide a lighted background to contrast a gap between two railroad cars;

means for mounting a camera on an opposite side of the railroad track and aiming the camera at the light uniform background functioning to capture an image of the gap between two railroad cars; and means for using a machine vision algorithm functioning to detect a low or broken air hose via an analysis of the image of the gap.

18. The system of claim 17, wherein the machine vision algorithm further comprises a vertical line shape edge finder tool.

19. The system of claim 17, wherein the machine vision algorithm further comprises a height algorithm to detect a height of a car coupler.

20. The system of claim 17 further comprising a railroad car radio identification tag reader means functioning to determine which gap has a low or broken air hose.

21. The system of claim 18, wherein the vertical line shape edge finder tool includes a step of moving a vertical line shape edge finder tool horizontally and vertically across the gap image to detect an air hose in the image by a predetermined width dimension of the air hose.

22. The method of claim 19, wherein the height algorithm includes a step of moving a vertical line shape edge finder tool horizontally and vertically across the gap image to detect coupler shanks in the image by their predetermined height dimension.

* * * * *